United States Patent [19]

Yamashita et al.

[11] 4,006,021

[45] Feb. 1, 1977

[54] SENSITIZING A GRANULAR DISPERSION OF A COLOR GENERATOR AND AN ORGANIC HALOGEN COMPOUND BY HEAT

[75] Inventors: Hiroshi Yamashita; Nobuyoshi Sekikawa; Hisatake Ono, all of Asaka, Japan

[73] Assignee: Fuji Photo Film Co., Ltd., Minami-ashigara, Japan

[22] Filed: Apr. 14, 1975

[21] Appl. No.: 567,965

Related U.S. Application Data

[63] Continuation-in-part of Ser. No. 245,401, April 19, 1972, abandoned.

[30] Foreign Application Priority Data

| | | |
|---|---|---|
| Apr. 20, 1971 | Japan | 46-24965 |
| Apr. 20, 1972 | United Kingdom | 18461/72 |
| Apr. 20, 1972 | Germany | 2219360 |
| Apr. 20, 1972 | France | 72.13971 |

[52] U.S. Cl. ..... 96/27 E; 96/90 R; 96/48 R; 96/48 QP; 96/48 HD

[51] Int. Cl.² ..... G03C 5/24; G03C 1/52

[58] Field of Search ..... 96/48 R, 90 R, 27 E, 96/48 QP, 48 HD, 90 PC

[56] References Cited

UNITED STATES PATENTS

| | | | |
|---|---|---|---|
| 3,476,562 | 11/1969 | Yamada et al. | 96/90 R |
| 3,510,304 | 5/1970 | Fichter et al. | 96/90 R |
| 3,607,266 | 9/1971 | Yamada et al. | 96/48 R |
| 3,649,284 | 3/1972 | Price | 96/90 R |
| 3,697,276 | 10/1972 | Lewis et al. | 96/90 R |
| 3,876,426 | 4/1975 | Yamashita et al. | 96/90 R |

*Primary Examiner*—Won H. Louie, Jr.
*Attorney, Agent, or Firm*—Sughrue, Rothwell, Mion, Zinn & Macpeak

[57] ABSTRACT

Two components consisting of an organic halogen compound generating halogen containing free-radicals and/or halogen ions due to the action of radiation and a color generator reacting with the thus generated halogen containing free-radicals and/or halogen ions to form a visible image are subjected to dispersion in the form of discrete globules in a hydrophilic binder, and the thus dispersed mixture is applied on a suitable support to thereby obtain a recording material. The entire surface of the thus obtained recording material is heated prior to the action of the radiation forming the visible color image in a dry treatment. The described process is suitable for image formation by negative-positive working photographic procedures.

26 Claims, 2 Drawing Figures

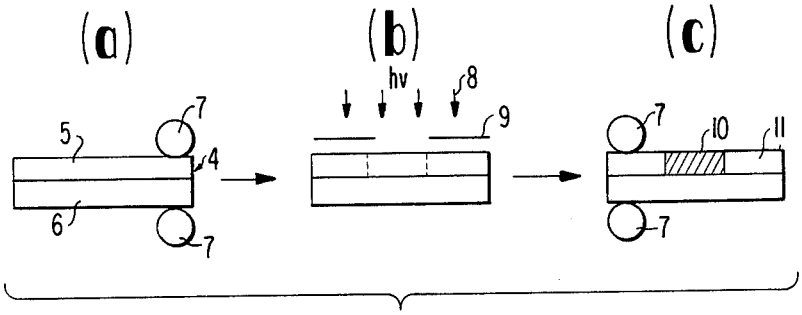
FIG. 1
FIG. 2
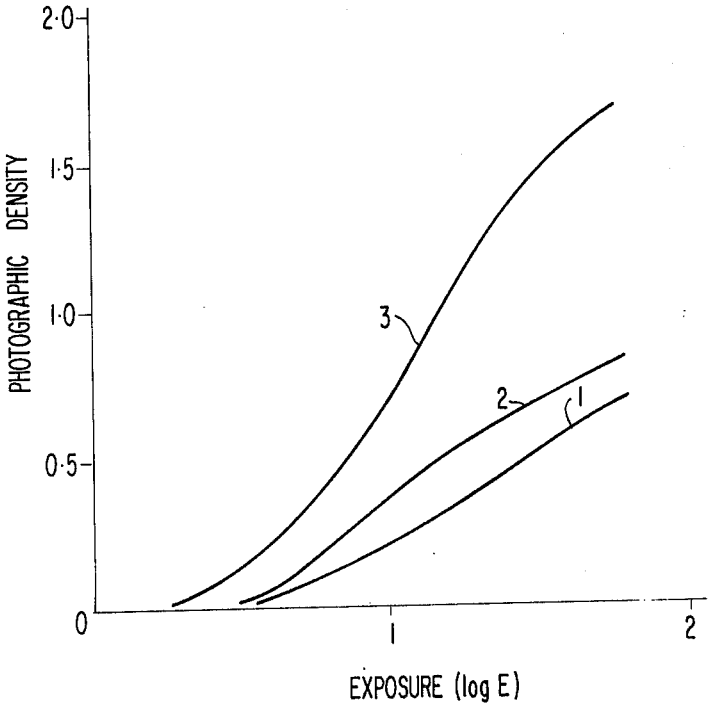

SENSITIZING A GRANULAR DISPERSION OF A COLOR GENERATOR AND AN ORGANIC HALOGEN COMPOUND BY HEAT

CROSS-REFERENCE TO RELATED APPLICATION

The present application is a continuation-in-part of U.S. application Ser. No. 245,401 filed Apr. 19, 1972, now abandoned in the name of Hiroshi Yamashita et al. and entitled "Dry Image Forming Method".

BACKGROUND OF THE INVENTION

1. Field of the Invention

This invention relates to a novel dry method for forming color images due to the action of radiation, and, more particularly, to a method for forming an image comprising preheating prior to irradiation of a recording material which comprises an organic halogen compound generating halogen containing free-radicals and/or halogen ions by the action of radiation and another compound which reacts with the thus generated halogen containing free-radicals and halogen ions to form a visible color image subjected to dispersion as discrete globules in a hydrophilic binder, the dispersed mixture being applied on a suitable support.

2. Description of the Prior Art

Heretofore, many examples of light-sensitive materials in which organic halogen compounds are employed are known; see, for example, the description on Pages 54–60 of *INSHA KOGAKU II* (Printing and Photographic Engineering) compiled by Wada and published by Kyoritsu Shuppan K.K. in 1969, and the description on Pages 361–380 of *Light Sensitive Systems* authored by J. Kosar and published by John Wiley & Sons, Inc., in 1965. Most of these materials are light-sensitive materials which are obtained by dispersing light-sensitive compositions in molecular form into a hydrophobic binder.

On the other hand, referring to a light-sensitive material prepared by dispersing a light-sensitive composition into a hydrophilic binder in the form of fine particles, there are U.S. Pat. Nos. 3,476,562 and 3,503,745. In these patents, a visible image is formed by radiation from a mercury arc lamp and then heating the light-sensitive material. However, the image density, D, obtained by such a method ranges from about 1.0 to 1.3, and furthermore, problems exist with the light fastness of the resulting image.

OBJECTS OF THE INVENTION

It is an object of the present invention to provide a novel image forming method by negative-positive working photographic procedures by which an image having a favorable light fastness is formed and image density, gamma or contrast are increased.

SUMMARY OF THE INVENTION

The present invention relates to a dry image forming method by negative-positive working photographic procedures comprising heat treating the surface of an image recording material, as hereinafter described, and then irradiating the material through a negative image to cause color formation at the irradiated areas.

The recording material employed in the method of the present invention is prepared by dispersing, into a hydrophilic binder as discrete oblate spheroids as hereinafter described which are also after referred to by the term "globules for simplicity", two components: an organic halogen compound and a color generator capable of reacting with halogen-containing free-radicals and halogen ions generated by the decomposition of the organic halogen compound due to the action of radiation to form a colored substance. If desired, a sensitizer, a stabilizer, an enhancer, and the like, can additionally be added thereto, these components also being dispersed into the hydrophilic binder as discrete globules. The thus dispersed mixture is applied on a suitable support material as a radiation sensitive layer.

The nature, details and utility of the invention will be more clearly apparent from the following detailed description beginning with general considerations and concluding with specific examples of preferred embodiments of the invention, the appended claims, and the several views illustrated in the accompanying drawings.

BRIEF DESCRIPTION OF THE ACCOMPANYING DRAWINGS

In the drawings,

FIG. 1 is a schematic diagram showing one example of image forming by the negative-positive working photographic procedures according to the present invention.

FIG. 2 is a graphical representation in which photographic characteristic Curves 2 and 3 were obtained by the formation of images in accordance with the method of the present invention, and photographic characteristic Curve 1 obtained by a conventional method are compared.

DETAILED DESCRIPTION OF THE INVENTION

The raw materials or components from which the recording material used in the method of this invention is produced will be described hereinafter in greater detail.

Firstly, as the organic halogen compound, compounds represented by the following general formulae may be used:

I. $RCX_3$ wherein R is a hydrogen atom, a halogen atom, an aryl group, a $C_1$–$C_5$ alkyl group, a $C_7$–$C_8$ aralkyl group or a carboxyl group; X is a chlorine atom, a bromine atom or an iodine atom. When R is an alkyl group it can optionally be substituted with OH or X.

II.

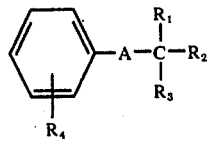

wherein $R_4$ is a hydrogen atom, a chlorine atom, a bromine atom, an iodine atom, a nitro group, a $C_1$–$C_5$ alkyl group, a $C_1$–$C_5$ alkoxyl group or a phenyl group;

A is $>C=O$, $>S=O$, $>S\begin{smallmatrix}O\\O\end{smallmatrix}$;

$R_1$, $R_2$ and $R_3$ are each a hydrogen atom, a chlorine atom or a bromine atom, with at least one of $R_1$, $R_2$ and $R_3$ being a chlorine or bromine atom.

III.

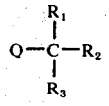

wherein Q is a substituted or unsubstituted heterocyclic compound, $R_1$, $R_2$ and $R_3$ are each a hydrogen atom, a chlorine atom or a bromine atom, with at least one of $R_1$, $R_2$ and $R_3$ being a chlorine or bromine atom.

IV. Halogenated quinone or aryl halide, in which the quinone residue is a group derived from quinone and the aryl residue is a group derived from benzene, cresol, xylene, naphthalene or phenolphthalein.

Other organic halogen compounds are disclosed in U.S. Pat. Nos. 3,512,975 and 3,560,216 and 3,560,216 and in "Photographic Science and Engineering", Vol. 8 p. 95–103, 1964.

More specifically, organic halogen containing compounds within the above general formulae, as well as other suitable compounds, include compounds such as carbon tetrachloride, hexabromoethane, pentrabromoethane, chloranil, bromanil, tetrachlorotetrahydronaphthalene, tetraiodomethane, iodoform, bromoform, trichlorobromomethane, tribromoethanol, tribromoacetic acid, hexachloroethane, p-phenylphenacyl bromide, tetrabromo-o-cresol, tetrabromophenolphthalein (i.e. 1,1-di(p-hydroxyphenyl)-3-oxo-4,5,6,7-tetrabromo-2-benzoxolene), hexabromobenzene, hexachlorobenzene, iodobenzene, carbon tetrabromide, 2,2,2-tribromoacetophenone, p-nitro-2,2,2-tribromoacetophenone, p,2,2,2-tetrabromoacetophenone, phenyl tribromomethylsulfone, 2-tribromomethyl quinoline and $\alpha$, $\alpha$, $\alpha$, $\alpha$, $\alpha$, $\alpha$-hexachloroxylene.

Secondly, organic compounds containing a nitrogen atom as the color generator employed in the recording material used in the method of the present invention as suitable. Of these materials, aromatic amines and leuco-pigments are preferred.

Examples of especially preferred organic compounds containing a nitrogen atom as the color generator include diphenylamine, dibenzylamine, aniline, carbazole, indole, triphenylamine, p,p'-benzylidine dianiline, 1,2-dianilinoethylene, p,p',p''-triamino triphenylmethane, benzidine, bis(p-amino-phenyl)methane, phenylenediamine, naphthylamine, p,p'-pentylidene dianiline and such materials substituted with substituents such as alkyl groups having 1–5 carbon atoms, aryl groups having 6–8 carbon atoms, aralkyl groups having 7–8 carbon atoms, nitro, amino, cyano, vinyl or hydroxy groups, alone or in various combinations thereof.

Specific examples of such color generators (organic compounds containing a nitrogen atom) which are suitable include materials such as diphenylamine, p-hydroxydiphenylamine, N-ethyldiphenylamine, o-nitrodiphenylamine, N,N-dimethylaniline, N,N-diethylaniline, N,N,N'N'-tetramethyl-p-phenylenediamine, N-phenyl-alpha-naphthylamine, N-phenyl-beta-naphthylamine, N,N-dimethyl-alpha-naphthylamine, N,N-dimethyl-beta-naphthylamine, N,N-dibenzylaniline, indole, N-vinyl-indole, 5-cyanoindole, 3-methylinodole, N,N'-diphenyl-p-phenylenediamine, benzidine, N,N'-diphenylbenzidine, 1,2-dianilinoethylene, 4,4', 4''-methenyltris (N,N-dimethylaniline), N-vinylcarbazole, p,p'-pentylidenebis (N,N-dimethylaniline), p,p', p''-triaminotriphenylcarbinol, p,p', p''-triaminotriphenylcarbinol, p,p', p''-triamino-o-methyltriphenylmethane, aniline, carbazole, dibenzylamine, N-phenyl-N-methylaniline, bis(p-dimethylaminophenyl)methane, N-phenylindole, o-aminodiphenylamine, p,p'-(dimethylamino)diphenylamine, N-ethylcarbazole, 3-phenylinodole, p-phenylenediamine, N,N,N', N'-tetraethyl-p-phenylene-diamine, triphenylamine, p,p'-benzylidene-bis(N,N-dimethylaniline), p,p'-(benzylidenedianiline), dibenzylethyl amine, dibenzylmethyl amine, p,p', p''-triamino triphenylmethane, $\alpha$-naphthylamine, $\beta$-naphthylamine and N-benzyl-N-ethylaniline.

While the organic halogen compound, the organic compound containing a nitrogen atom and the hydrophilic high molecular weight binder are mandatory components, the sensitizer, stabilizer and enhancer are optional, but highly preferred components. For practical purposes, the photographic material of the present invention is used on a support, though such is not necessary with a self-supporting high molecular weight binder.

Thirdly, as sensitizers which can be employed in the recording material used in the method of the present invention, compounds which function as a sensitizer counteracting any deactivating reactions toward color forming which might occur can be employed in addition to compounds by which the coloring reaction is chemically or spectrally sensitized.

More specifically, suitable sensitizers which can be employed for the present invention can be exemplified by compounds such as the anthraquinones, the metallocenes, the hydrazones, the aromatic amine N-oxides, and photographic spectral sensitizing dye materials which are in the dye form or in the dye base form, such as the azo dyes, diphenylmethane dyes, triphenylmethane dyes, anthraquinone dyes, methine dyes, polymethine dyes, acridine dyes, azine dyes, thiazine dyes, oxazine dyes, styryl dyes, cyanine dyes, carbocyanine dyes, merocyanine dyes, xanthene dyes and the dye base form thereof.

Fourthly, the stabilizer employed in the recording material used in the method of the present invention is a compound having the function of improving the stability of the light-sensitive material during storage thereof. Suitable stabilizers are, for example, hydroquinone, resorcin, catechol, and derivatives thereof, amides, thiourea. and derivatives thereof, for example, amides having the general formula $$R_5CONR_6R_7$$

wherein $R_5$, $R_6$ and $R_7$ are each a hydrogen atom, an alkyl group, having 1 to 5 carbon atoms an aryl group, wherein the aryl group is a phenyl or naphthyl group, or an aralkyl group having 7 to 8 carbon atoms. Examples of suitable amides are formamide, N,N-dimethylformamide, N,N-dimethylacetoamide, and the like. Also, hydroquinone derivatives of the general formula

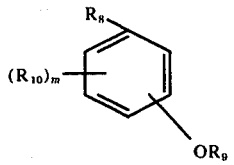

wherein $R_8$ and are each a hydrogen atom, an $C_1$ –$C_5$ alkyl group, an aryl group, wherein the aryl group is a phenyl or naphthyl group, an acetyl group, a hydroxyalkyl group having 1 to 5 carbon atoms, a benzoyl group or a

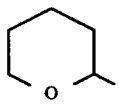

group; and $R_{10}$ is alkyl group having 1 to 5 carbon atoms, a hydroxyl group, a halogen atom or an alkoxyl group having 1 to 5 carbon atoms and *m* is an integer of 1 to 4 can be used. Specific examples of such hydroquinone derivatives are hydroquinone monoethyl ether, hydroquinone diethyl ether and the like.

Fifthly, the enhancer employed in the recording material of the present invention is a compound which functions to change the color tone of the resulting image, particularly converting the image tone to a deeper tone, thereby increasing the image density. Examples of such compounds are furfurylidene compounds represented by the following general formulae:

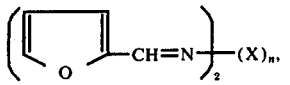

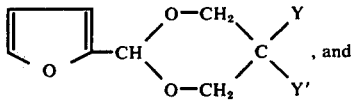

, and

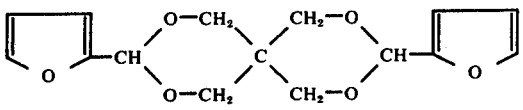

wherein X is

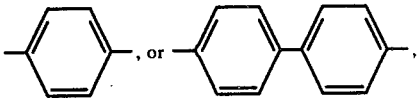

Y and Y′ are hydrogen or alkyl groups having from about 1 to 5 carbon atoms and *n* is 0 or 1.

Sixthly, a hydrophilic high molecular weight compound is employed as a binder to suspend the above-described components to form the recording material used in the method of the present invention. Suitable hydrophilic high molecular weight compounds which can be employed in the recording material used in the present invention are water soluble high molecular weight compounds such as gelatin, polyvinyl alcohol, polyvinyl pyrrolidone, casein, starch, carboxymethyl cellulose, gum arabic, hydroxymethyl cellulose, and similar film-forming polymeric materials.

Finally, suitable supports which can be employed for the recording material used in the method of the present invention are sheets such as papers, glasses, plastic films and thin metal plates. The support is non-critical.

The above-described components such as the organic halogen compound, the color generator, etc., are dispersed as discrete globules into the hydrophilic binder and the thus dispersed mixture is applied on the support and dried to obtain the recording material. Conventional image recording is carried out employing the recording material of the present invention using ultraviolet or visible light irradiation followed by heating (optional).

In the recording material of this invention for each 1 part color generator the amount of organic halogen compound ranges from 0.02 to 5 parts, preferably 0.2–5 parts, the sensitizer from $10^{-5}$ to 1 part, preferably $10^{-5}$ to $10^{-3}$ parts, the stabilizer from $10^{-5}$ to 10 parts, preferably $10^{-5}$ to $10^{-2}$ parts, and the enhancer from $10^{-3}$ to 10 parts, preferably $10^{-2}$ to 2 parts, for example, in 100 parts of hydrophilic binder.

As a result of our studies in this area, that is, image formation using various methods, it has been discovered that image recording can also be attained using electron beams, X-rays, gamma-rays and the like, in addition to ultraviolet light or visible light, and further, that in contrast to conventional techniques, when the entire surface of the recording material is heated prior to the coloring reaction resulting from irradiation as described above, the rate of color formation thereafter is markedly accelerated.

According to the present invention, a novel method for forming an image by negative-positive working photographic procedures employing the above-described recording material is provided. That is, in the method of the present invention, heating of the entire surface of the recording material is carried out prior to radiation causing the coloring reaction thereof. Hereinafter, the heating operation as described above will be referred to as the "preheating operation", and the effects obtained by the preheating operation will be correspondingly referred to as "preheating effects".

Reference is now made to FIG. 1 which exemplifies the image forming method of the present invention.

FIG. 1 shows an image forming method of the present invention according to negative-positive working photographic procedures in which a recording material 4 comprising a light-sensitive layer 5 and a support 6 is passed through heating rollers 7, 7 to heat the same, whereafter radiation 8 is applied to the recording material through a photographic negative film 9. The recording material 4 thus irradiated is again heated by passing the material through heating rollers 7,7 to thereby obtain a clear image of an image portion 10 and a non-image portion 11. In this case, the heating step shown in FIG. 1*c* is not necessarily required, i.e., the post-heating step which is optional is, however, highly preferred when using N-vinylcarbazole as the color generator, as N-vinylcarbazole will occasionally have a tendency to yield images of somewhat lesser quality than other color generators unless the post-exposure heating step is used.

Imagewise exposure is most preferably conducted utilizing radiation having a wavelength of from about 250 to about 550 nm., for a period of from about $10^{-4}$ seconds to about $10^{-3}$ seconds. On a commercial basis, a practical imagewise exposure is for from $10^{-3}$ seconds to 20 seconds. For commercial operation, imagewise exposure is most preferably conducted using irradiation of a wavelength of 350 to 500 nm.

The intensity of imagewise exposure can vary substantially, but generally will be from about $10^3$ to about $10^8$ erg/sq.cm. × sec., most preferably $5 \times 10^3$ to $10^8$ erg/sq.cm. × sec., providing an exposure amount (light intensity × irradiation time) of greater than about $5 \times 10^4$ erg/sq.cm.

The characteristic features of the operations illustrated in FIG. 1 differ from conventional operations in the point of heating the recording material in the process steps illustrated in FIG. 1*a*.

FIG. 2 is a graphical representation in which the photographic curves of the images obtained by the image forming method (illustrated in FIG. 1) according to the present invention are compared with the photographic curve obtained using a conventional method. In FIG. 2, the ordinate represents the photographic reflection density and the abscissa indicates the logarithm of the exposure (relative value), respectively.

Curve 1 in FIG. 2 is a photographic characteristic curve of the image obtained using a conventional method in which a recording material of the composition described above is exposed for 1 second to a 250 watt high pressure mercury lamp at a distance of 35 cm from the recording material and then the entire surface of the recording material thus exposed is heated to a temperature of 110° C., for 3 seconds.

On the other hand, Curves 2 and 3 in FIG. 2 are photographic characteristic curves of the images obtained using the method of the present invention. With respect to Curve 2, the entire surface of the recording material is heated to a temperature of 70° C., for 30 seconds, then, the recording material thus heated is exposed for 1 second, under a 250 watt high pressure mercury lamp at a distance of 35 cm from the recording material, and thereafter, the entire surface of the recording material thus exposed is heated at a temperature of 110° C., for 3 seconds. Furthermore, photographic characteristic Curve 3 is taken from the image obtained following the present invention wherein the entire surface of the recording material is heated at a temperature of 110° C., for 30 seconds, the recording material thus heated then is exposed for 1 second under a mercury arc lamp, and finally the entire surface of the recording material is heated for 3 seconds at a temperature of 110° C.

In FIG. 2, comparing photographic characteristic Curve 1 with photographic characteristic Curves 2 and 3, the following observations can be made:

Firstly, the maximum density $D_{max}$ of the resulting image obtained in the present invention is unexpectedly increased by a value of 1.00 from the $D_{max}$ 0.70 of the image obtained using the conventional method to the $D_{max}$ 1.70 of the image obtained using the method of the present invention.

Secondly, if the sensitivity of a recording material is indicated by the reciprocal of the exposure imparted, such density being fogging density plus 0.2, about twice the sensitivity of the recording material can be obtained by the preheating of the present invention, i.e., sensitivity is increased about two-fold by the preheating of the present invention.

As described above, the following five "preheating effects" or advantages can be obtained by the preheating operation of the present invention:

1. The density of the image obtained by the method of the present invention is increased to about twice the amount of that of a conventional one.
2. The light fastness of the image obtained by the method of the present invention is markedly advantageous.
3. The tone of the image obtained by the method of the present invention is favorable.
4. The sensitivity of the recording material of the present invention is about twice as high as that of a conventional one.
5. The gamma value of the image obtained by the method of the present invention is larger than that of a conventional one.

Two of the most important benefits achieved with the preheating of the present invention are that the preheating enables high contrast images to be obtained and also accelerates the rate of color generation.

While not desiring to be bound by theory, it is believed that the above-described phenomena can be explained as follows.

For simplicity in this explanation, it is assumed that the light-sensitive substance(s) and the auxiliary substance(s) essentially comprise only two components *a* and *b*. In these circumstances, it is believed that when both *a* and *b* components are dispersed in the form of fine globules, then either or both components *a* and *b* are activated by heating, and further, when radiation is applied to the components thus activated, components *a* and *b* tend to react with each other.

Furthermore, it is believed that where physical and chemical interactions occur between components *a* and *b* and a melting point depression results, the fine globules of components *a* and *b* become molten on heating at a temperature of about 150° C., in the case where the melting point of either of the components *a* and *b* is comparatively low, whereby the coloring reaction of the components is facilitated. In such a case, i.e., where the components tend to be melted, the preheating effects are particularly marked. This is a most preferred form of the present invention.

Suitable heating means which can be used in the present invention include a heating element, an air thermostat, an infrared lamp, microwaves using commercially available microwave ovens, heating employing an air dryer, and the like. Particularly, heating in which a heating element is employed is preferred.

In this case, the heating temperature for the preheating effect can range from about 35° to about 250° C., and is preferably conducted for from about 0.5 to about 60 seconds, more preferably from about 70° C to about 150° C., for about 0.5 to about 30 seconds.

After imagewise exposure, the heating can be at conventional temperatures ranging from about 50° to 250° C., more preferably from 70° to 140° C., for a period of from about 0.5 to about 60 seconds, and most preferably from 70° to 110° C., for a period of from 1 to 10 seconds. It is most preferred in accordance with the present invention that the heating after imagewise exposure is at a temperature lower than the preheating temperature.

The preheating effects as described above are particularly marked in a system dispersed as discrete globules. It is, of course, possible in principle to attain the preheating effect in a molecular dispersion system.

However, for example, where the components of the recording material of the present invention are dispersed in polystyrene, since most organic halogen compounds have sublimating characteristics, the organic halogen compound component is sublimated by the preheating operation, the quantity of the organic halogen compound contributing to the coloring reaction decreases, and, as a result, rather an adverse effect is obtained by the preheating operation.

In such a case, therefore, it is possible to attain the preheatng effect of the present invention by employing a halogen compound having less sublimating property as the organic halogen compound of the present invention or by applying one or more layers on the surface of the light-sensitive layer of the recording material to thereby prevent the sublimation of the organic halogen compound.

The components such as the organic halogen compound (the color generator or the like) are usually in the shape of oblate spheroids (a spheroid in which) the equatorial diameter in greater than the distance between the poles.) The equatorial distance will be hereinafter referred to as "diameter" of and the distance between the poles will be referred to by the term "thickness". The oblate spheroids of the components described above have on a dry basis, a diameter of from 0.05 to 30 microns, preferably, to 6 microns, and have a thickness of from 0.02 to 10 microns, preferably 0.4 to 2 microns.

In order to explain and illustrate the present invention and the manner in which it may be practiced in greater detail, the following specific examples are given. In these examples, the preparation and treatments of the recording materials are carried out using the light from a photographic red safety lamp. It is to be appreciated, however, that these examples are merely examplary of the present invention and are not to be taken as a limitation thereon.

The dispersed liquid comprising the above components is applied to a suitable support, which is subsequently dried to prepare a recording material. The drying temperature is preferably lower than 50° C.

A dry thickness of the light sensitive layer is 2 to 150 microns, preferably 10 to 40 microns.

EXAMPLE 1

Into 25 ml. of a 16% aqueous gelatin solution 2.5 g of N-vinylcarbazole was added and the mixture was agitated at high speed employing a homogenizing mixer (manufactured by Tokushu Kita Kogyo K.K.) at a temperature of 70° C., for 2 minutes, thereby to disperse the N-vinylcarbazole into the gelatin as discrete globules as a discontinuous phase. The globule size was 1 to 6 microns in diameter and 0.4 to 2 microns in thickness, with most of the globules having a diameter of 4 to 5 microns, 1.5 g of carbon tetrabromide and 0.5 g of hexachloroethane were added to the resulting dispersed liquid and were emulsified and dispersed in a similar manner to that described above. The dispersed liquid thus prepared was applied on a baryta paper and dried to thereby obtain a recording material. The dry thickness of the light sensitive layer was 22 microns.

The recording material thus obtained was heated at a temperature of 110° C., for 20 seconds, the recording material thus heated was then exposed for 1 second through a photographic negative film to a 250 watt high pressure mercury lamp at a distance of 35 cm from the recording material the wavelength was 300 to 500 mm and, the intensity of imagewise exposure was $2\times10^6$ erg/cm$^2$. sec), and the recording material thus exposed was then heated at a temperature of 110° C., for 3 seconds to thereby obtain an indigo blue image with a light yellow background. The image density of the resulting positive image was 1.72.

For comparison, another recording material was exposed for 1 second through a photographic negative film to a high pressure mercury lamp under the above conditions but without the preheating operation, whereafter, the recording material thus exposed was heated at a temperature of 110° C., for 3 seconds to thereby obtain a greenish gray image with a light yellow background. The image density of the resulting positive image was only 0.81.

As described above the marked effect of an increase in image density of 0.91 was obtained by the preheating operation of the present invention, and the gamma value of the image was also increased.

Furthermore, upon leaving the resulting images in a bright room the light fastness of both resulting images obtained as described above, was measured. The color of the image obtained without preheating changed from greenish gray to brown.

On the other hand, the color of the image obtained with preheating was not changed from indigo blue and was only slightly darkened. The light fastness of this image was excellent.

As a result of the preheating of the present invention, the following three advantages were obtained:

i. The maximum image density $D_{max}$ became substantially twice the image density of the non-preheated image.

ii. The light fastness of the resulting image was superior.

iii. The color tone of the resulting image was superior (that is, it changed from greenish gray to indigo blue).

EXAMPLE 2

| | |
|---|---|
| N-vinylcarbazole (color generator) | 5g |
| 4-(p-dimethylamino)styrylquinoline (sensitizer) | 1 mg. |
| Carbon tetrabromide (organic halogen compound) | 3g |
| N,N-dimethylacetamide (stabilizer) | 0.2g |

The above compounds were added to 50 ml. of a 16% aqueous gelatin solution in the order of the compounds set forth above and emulsified and dispersed in the gelatin solution. The resulting dispersed liquid was then applied to a suitable support of baryta paper and dried to thereby prepare a recording material.

In the light-sensitive layer of the recording material, the above described compositions were contained as discrete globules, each having an average size of 2–5 microns, and further, it appeared that the aforesaid fine globules were discontinuously dispersed in the gelatin.

The recording material thus obtained was heated at a temperature of 70° C., for 30 seconds, the recording material then was imagewise exposed through a negative for 1 second to a 250 watt high pressure mercury lamp at a distance of 35 cm from the recording material, and thereafter, the recording material thus exposed was heated at a temperature of 110° C., for 3 seconds to thereby obtain an indigo blue positive image with a light yellow background. The color of the resulting image was not substantially changed even in a bright room.

In FIG. 2 of the accompanying drawings, two photographic characteristic curves (Curves 2 and 3) of the images formed by the method of the present invention in which the preheating operation was carried out and another photographic characteristic curve (Curve 1) of the image formed using a conventionally known method are shown, respectively.

The treating conditions of the above image forming methods were as follows:

Curve 1: After irradiation with the mercury arc lamp for 1 second, heated at a temperature of 110° C., for 3 seconds.

Curve 2: After heating at a temperature of 70° C., for 30 seconds, irradiated with a mercury arc lamp for 1 second, as in Curve 1 above, and further heated at a temperature of 110° C., for 3 seconds.

Curve 3: After heating at a temperature of 110° C., for 30 seconds, irradiated with a mercury arc lamp for 1 second, as in Curve 1 above, and further heated at a temperature of 110° C., for 3 seconds.

From FIG. 2, the following preheating effects were observed:

i. The maximum image density $D_{max}$ of the image according to the method of the present invention was 1.70; this value was surprisingly larger than that of the image without preheating, by a difference of 1.00.

ii. The gamma value of the image which was preheated was larger than that of the image without preheating.

iii. The photographic characteristic curves of the images obtained according to the present invention were transferred leftwardly by the preheating operation. That is, an image having the same image density as that of an image formed using a conventional method could be obtained by the irradiation with a smaller exposure time in the present invention than that obtainable using the conventional method.

Furthermore, when the sensitivity of a recording material was estimated by the reciprocal value of the exposure imparting an image density of fogging density plus 0.2, the sensitivity of the recording material of the present invention increased by a factor of 2 with respect to that of a conventional recording material.

EXAMPLE 3

| | |
|---|---|
| N-vinylcarbazole (color generator) | 5g |
| Iodoform (organic halogen compound) | 0.5g |
| Hexachloroethane (organic halogen compound) | 1g |
| Carbon tetrachloride (organic halogen compound) | 2g |

The above compounds were added to 50 ml. of a 15% aqueous polyvinyl alcohol solution in the order as above indicated and emulsified and dispersed in the polyvinyl alcohol solution. Generally, in a case as described above, the dispersion efficiency could be elevated by the addition of an aqueous solution of a suitable surface active agent, e.g., a 1% aqueous solution of sodium n-dodecyl sulfonate.

The resulting dispersed liquid was then applied on a polyester film base and dried to thereby produce a recording material.

The recording material thus produced was heated at a temperature of 140° C., for 10 seconds, the recording material thus heated was then imagewise exposed through a negative for 1 second to a mercury arc lamp at a distance of 35 cm from the recording material, and thereafter the recording material thus exposed was again heated at a temperature of 110° C., for 3 seconds to thereby obtain a bluish black positive image with a light yellow background.

EXAMPLE 4

| | |
|---|---|
| N-vinylcarbazole (color generator) | 5g |
| Carbon tetrabromide (organic halogen compound) | 3.2g |
| 4-(p-dimethylamino)styrylquinoline (sensitizer) | 4 mg |
| Dimethylformamide (stabilizer) | 0.2g |
| Furfurylidenepentaerythritol (enhancer) | 1g |
| 1% Aqueous sodium n-dodecylsulfonate solution (surfactant) | 1 ml. |

The above listed compounds were emulsified and dispersed in 50 ml. of 16% aqueous gelatin solution to prepare a dispersed liquid. The dispersed liquid thus prepared was then applied on a suitable support member of baryta paper and dried to thereby produce a recording material.

The recording material thus produced was heated at a temperature of 130° C., for 10 seconds and then the thus heated recording material was subjected to image exposure through a negative for 10 seconds under a 250 watt high pressure mercury lamp at a distance of 35 cm from the recording material, whereby a deep black positive image with a light yellow background was obtained.

EXAMPLE 5

| | |
|---|---|
| N-vinylcarbazole (color generator) | 2.5 g |
| Carbon tetrabromide (organic halogen compound) | 2.5 g |
| 4-(p-dimethylamino)styrylquinoline (sensitizer) | 1 mg |

The above-listed compounds were dispersed into 50 ml of 16% aqurous gelatin solution to prepare a dispersed liquid. The dispersed liquid thus prepared was then applied on a suitable support of baryta paper and dried, thereby producing a recording material.

The recording material thus produced was heated at a temperature of 140° C., for 10 seconds: the thus heated recording material was then subjected to image exposure through a negative for 1 second to a mercury arc lamp and thereafter the entire surface of the resulting recording material was heated at a temperature of 70° C., for 5 seconds to thereby obtain a deep blue positive image.

EXAMPLE 6

| | |
|---|---|
| N benzyl-N-ethylaniline (color generator) | 2.5g |
| Carbon tetrabromide (organic halogen compound) | 2.5g |

The above compounds were dispersed into 30 ml of 16% aqueous gelatin solution to prepare a dispersed liquid. The dispersed liquid thus prepared was then applied on a suitable support member and dried to thereby produce a recording material.

The recording material thus produced was heated at a temperature of 130° C., for 10 seconds and was then subjected to image exposure through a negative for 10 seconds to a mercury arc lamp, whereby a blue positive image with a light yellow background was obtained.

Where the recording material was not subjected to preheating, the color of the resulting image was greenish blue.

The image density of the resulting image obtained by preheating was selected by about 0.3.

EXAMPLE 7

In this example, a recording material prepared as in Example 5 was employed, except that 30 ml of a 16% aqueous gelatin solution was used.

The entire surface of the recording material was heated at a temperature of 110° C., for 10 seconds, the recording material thus heated was then exposed for 1 second to a mercury arc lamp through a negative photograph, and thereafter, the resulting recording material was further exposed for 100 seconds for drying through a glass filter (CS 7-69 manufactured by Corning Glass Works Co., Ltd.) to infrared lamps (375 watts) at a distance of 20 cm from the recording material, whereby a deep bluish black image was obtained. In this case, the light resistance of the resulting image was superior.

A commercially available microwave oven may be employed in place of the infrared lamps used in the above-described case. Where a microwave oven is employed, the plastic sheets inside of the microwave oven function similar to hot plates due to heating caused due to the microwave oven over a long period of time.

EXAMPLE 8

N-ethyldiphenylamine was used as a color generator in this example and a recording material was treated using the same procedures as described in Example 6.

The light fastness of the resulting image was superior.

EXAMPLE 9

A recording material as prepared in Example 5 was employed in this example.

The recording material was exposed through a negative photograph for 60 seconds to radiation from 375 watt infrared lamps at a distance of 25 cm from the recording material, whereby a bluish black image was obtained.

In this case, it is believed that the heating effects due to the irradiation with infrared rays and the coloring reaction due to the visible rays functioned concurrently on the recording material, whereby similar effects as those of preheating could be attained.

While the invention has been described in terms of various embodiments thereof, it will be apparent that various modifications and changes can be made therein without departing from the spirit and scope thereof.

What is claimed is:

1. A dry method for forming a colored image by a negative - positive working photographic procedure which comprises:

1. heating a dried recording material, which recording material comprises a support having thereon a color image - forming system comprising a dispersion of discrete oblate spheroids of (a) an organic-halogen compound and (b) a separate color generator which is an organic compound containing a nitrogen atom, in a hydrophilic binder, said organic halogen compound generating halogen ions and/or free radicals containing halogen on irradiation which react with said color generator, and said organic compound containing a nitrogen atom being selected from the group consisting of diphenylamine, n-hydroxydiphenylamine, N-ethyldiphenylamine, o-nitrodiphenylamine, N, N-dimethylaniline, N, N-diethylaniline, N, N, N', N'-tetramethyl-p-phenylenediamine, N-phenyl-alpha-naphthylamine, N-phenyl-beta-naphthylamine, N, N'-dimethyl-alpha-naphthylamine, N, N'-dimethyl-beta-naphthylamine, dibenzylaniline, indole, N-vinylindole, 5-cyanoindole, 3-methylindole, triphenylamine, N, N'-diphenyl-p-phenylenediamine, benzidine, N, N'-diphenylbenzidine, 1, 2-dianilinoethylene, 4,4', 4''-methenyltris (N,N-dimethylaniline), N-vinylcarbazole, p,p'-pentylidenebis(N,N-dimethylanilene), p,p',p''-triaminotriphenyl-carbinol, p,p', p''-triamino-o-methyltriphenylmethane, aniline, carbazole, dibezylamine, N-phenyl-N-methylaniline, bis(p-dimethylaminophenyl)methane, N-phenylindole, o-aminodiphenylamine, p,p'-(dimethylamino)diphenylamine, N-ethylcarbazole, 3-phenyl-indole, p-phenylenediamine, N, N, N', N'-tetramethyl-p-phenylene-diamine, triphenylamine, p, p'-benzylidene-bis (N,N-dimethylaniline), p,p'-benzylidenedianiline, dibenzylethyl amine and dibenzylmethyl amine;
2. thereafter imagewise exposing said recording material to radiation to form a visible color image of the reaction product of said color generator and the product(s) generated from said organic halogen compound;

the heating of Step (1) being at a temperature of from about 60° C., to about 150° C., for a time sufficient to increase the density of said visible color image to about twice the density obtained with an otherwise identical recording material which has not been subjected to said heating.

2. The method according to claim 1, wherein said hydrophilic binder additionally contains dispersed therein as discrete oblate spheroids at least one of a sensitizer, a stabilizer and an enhancer.

3. The method according to claim 1, wherein said organic halogen compound is a compound represented by one of the following general formulae:

I. $RCX_3$ wherein R is a hydrogen atom, a halogen atom, an aryl group, a $C_1$–$C_5$ alkyl group, a $C_7$–$C_8$ aralkyl group or a carboxyl group; X is a chlorine atom, a bromine atom or an iodine atom, and when R is an alkyl group it can optionally be substituted with OH or X,

II.

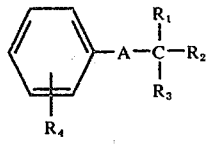

where X is as hereinbefore described:

wherein $R_4$ is a hydrogen atom, a chlorine atom, a bromine atom, an iodine atom, a nitro group, a $C_1$–$C_5$ alkyl group, a $C_1$–$C_5$ alkoxyl group or a phenyl group;

A is $>C=O$, $>S=O$, $>S\begin{smallmatrix}O\\O\end{smallmatrix}$;

$R_1$, $R_2$ and $R_3$ each are a hydrogen atom, a chlorine atom or a bromine atom, with at least one of $R_1$, $R_2$ and $R_3$ being a halogen atom;

III.

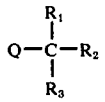

wherein Q is a substituted or unsubstituted heterocyclic compound, $R_1$, $R_2$ and $R_3$ each are a hydrogen atom, a chlorine atom or a bromine atom, with at least one of $R_1$, $R_2$, $R_3$ being a halogen atom; and a halogenated quinone or an aryl halide, in which the quinone residue is a group derived from quinone and the aryl residue is a group derived from benzene, cresol, xylene naphthalene or phenolphthalein.

4. The method according to claim 1, wherein said organic halogen containing compound is selected from the group consisting of carbon tetrachloride, hexabromoethane, pentabromoethane, chloranil, bromanil, tetrachlorotetrahydronaphthalene, tetraiodomethane, iodoform, bromoform, trichlorobromomethane, tribromoethanol, tribromoacetic acid, hexachloroethane, p-phenylphenacyl bromide, tetrabromo-o-cresol, tetrabromo-phenolphthalein, hexabromobenzene, hexachlorobenzene, iodobenzene, carbon tetrabromide, tribromoacetophenone, p-nitrotribromoacetophenonene, p-bromotribromoacetophenone, tribromophenylsulfone and hexachloroxylene.

5. The method according to claim 2, wherein said organic halogen compound is a compound represented by one of the following general formulae:

I. $RCX_3$ wherein R is a hydrogen atom, a halogen atom, an aryl group, a $C_1$–$C_5$ alkyl group, a $C_7$–$C_8$ aralkyl group or a carboxyl group; X is a chlorine atom, a bromine atom or an iodine atom, and when R is an alkyl group it can optionally be substituted with OH or X, wherein X is as hereinbefore described;

II.

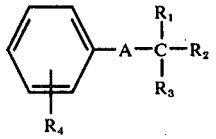

wherein $R_4$ is a hydrogen atom, a chlorine atom, a bromine atom, an iodine atom, a nitro group, a $C_1$–$C_5$ alkyl group, a $C_1$–$C_5$ alkoxyl group or a phenyl group; A is

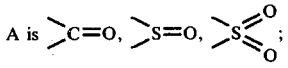

$R_1$, $R_2$ and $R_3$ each are a hydrogen atom, a chlorine atom, a bromine atom, with at least one of $R_1$, $R_2$ and $R_3$ being a halogen atom:

III.

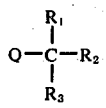

wherein Q is a substituted or unsubstituted heterocyclic compound $R_1$, $R_2$ and $R_3$ each are a hydrogen atom, a chlorine atom or a bromine atom, with at least one of $R_1$, $R_2$ and $R_3$ being a halogen atom:

IV. a halogenated quinone or an aryl halide, in which the quinone residue is a group derived from quinone and the aryl residue is a group derived from benzene, cresol, xylene naphthalene or phenolphthalein.

6. The method according to claim 2, wherein said organic halogen containing compound is selected from the group consisting to carbon tetrachloride, hexabromoethane, pentabromoethane, chloranil, bromanil, tetrachlorotetrahydronaphthalene, tetraiodomethane, iodoform, bromoform trichlorobromomethane, tribromoethanol, tribromoacetic acid, hexachloroethane, p-phenylphenacyl bromide, tetrabromo-o-cresol, tetrabromophenolphthalein, hexabromobenzene, hexachlorobenzene, iodobenzene, carbon tetrabromide, 2,2,2-tribromoacetophenone, p-nitro-2,2,2-tribromoacetophen, p-2,2,2-tetrabromoaceto-phenone, phenyl tribromomethylsulfone, 2-tribromomethyl quinoline, and $\alpha,\alpha,\alpha,\alpha',\alpha',\alpha'$,-hexachloroxylene.

7. The method according to claim 2, wherein said sensitizer is a member selected from the group consisting of the anthraquinones, the metallocenes, the hydrazones, the aromatic amine N-oxides, and the spectral sensitizing dye materials selected from the group consisting of the azo dyes, triphenylmethane dyes, anthraquinone dyes, methine dyes, polymethine dyes, acridine dyes, azine dyes, thiazine dyes, oxazine dyes, stryl dyes, cyanine dyes, carbocyanine dyes, merocyanine dyes, xanthene dyes in their dye form and their dye base form.

8. The method according to claim 2, wherein said stabilizer is a compound selected from the group consisting of hydroquinone, resorcin, catechol, and their derivatives, amides, thiourea and their derivatives.

9. The method according to claim 2, wherein said enhancer is a member selected from the group of furfurylidene compounds represented by the following general formulas:

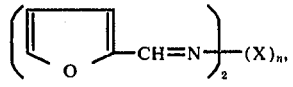

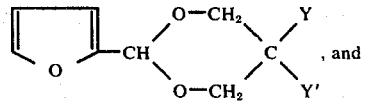

, and

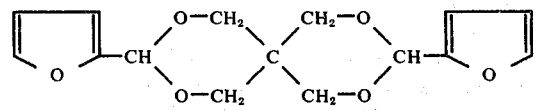

wherein

X is 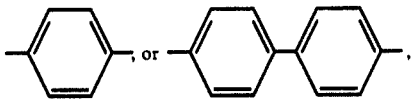

Y and Y′ are hydrogen or alkyl groups each having from 1 to about 5 carbon atoms, and $n$ is 0 or 1.

10. The method according to claim 1, wherein said hydrophilic binder is a water soluble high molecular weight compound selected from the group consisting of gelatin, polyvinyl alcohol, polyvinyl pyrrolidone, casein, starch, carboxymethyl cellulose, gum arabic, and hydroxymethyl cellulose.

11. The method according to claim 2, wherein said hydrophilic binder is a water soluble high molecular weight compound selected from the group consisting of gelatin, polyvinyl alcohol, polyvinyl pyrrolidone, casein, starch, carboxymethyl cellulose, gum arabic and hydroxymethyl cellulose.

12. The method according to claim 1, wherein said support is a sheet material selected from the group consisting of papers, glasses, plastic films and thin metal plates.

13. The method according to claim 2, wherein said support is a sheet material selected from the group consisting of papers, glasses, plastic films, and thin metal plates.

14. The method according to claim 1, wherein the amount of organic halogen compound is from 0.002 to 5 parts per one part of color generator.

15. The method according to claim 14, wherein the amount of organic halogen compound is from 0.2 to 5 parts per one part of color generator.

16. The method of claim 1, which further comprises heating the imagewise exposed element of Step (2) at a temperature lower than the heating of Step (1).

17. The method of claim 1, which further comprises heating the imagewise exposed element of Step (2) at a temperature of from about 70° to about 140° C, for a period of from about 0.5 to about 60 seconds.

18. The method of claim 17, wherein said heating is at 70° to 110° C, for from 1 to 10 seconds.

19. The method of claim 1, wherein said imagewise exposure is conducted utilizing radiation of a wavelength of from about 250 to about 550 nm., for a period of from about $10^{-4}$ to about $10^{3}$ seconds.

20. The method of claim 19 wherein said radiation is of a wavelength of from 350 to 500 nm., for a time of from $10^{-3}$ to 20 seconds.

21. The method of claim 19 wherein the intensity of the radiation used for imagewise exposure is from about $10^{3}$ to about $10^{8}$ erg/sq. cm. × sec.

22. The method of claim 19 wherein the intensity of the radiation used for said imagewise exposure is from $5 \times 10^{3}$ to $10^{8}$ erg/sq. cm. × sec.

23. The method of claim 21 where the exposure amount is greater than $5 \times 10^{4}$ erg/sq. cm.

24. The method of claim 22 wherein the exposure amount is greater than $5 \times 10^{4}$ erg/sq. cm.

25. The method of claim 1 wherein the heating of Step (1) is at a temperature of from 70° to 150° C, for from about 0.5 to about 30 seconds.

26. The method of claim 1 wherein said discrete oblate spheroids have an equatorial diameter of from 0.05 to 30 microns and a distance between the poles of from 0.02 to 10 microns, on a dry basis.

* * * * *